US005171139A

United States Patent [19]

Underwood et al.

[11] Patent Number: 5,171,139

[45] Date of Patent: Dec. 15, 1992

[54] MOINEAU MOTOR WITH CONDUITS THROUGH THE STATOR

[75] Inventors: Lance D. Underwood, Spring; Harold D. Johnson, Houston; Charles H. Dewey, Houston; Mark J. Hommel, Houston, all of Tex.

[73] Assignee: Smith International, Inc., Houston, Tex.

[21] Appl. No.: 798,383

[22] Filed: Nov. 26, 1991

[51] Int. Cl.[5] ..... F03C 2/08

[52] U.S. Cl. ..... 418/48; 418/83; 418/153; 418/181; 29/888

[58] Field of Search ..... 418/14, 48, 83, 153, 418/181; 175/107; 29/888

[56] References Cited

U.S. PATENT DOCUMENTS

| | | | |
|---|---|---|---|
| 2,085,115 | 6/1937 | Moineau | 418/48 |
| 3,139,035 | 6/1964 | O'Connor | 418/48 |
| 3,840,080 | 10/1974 | Berryman | 175/107 |
| 3,982,858 | 9/1976 | Tschirky | 418/48 |
| 4,059,165 | 11/1977 | Clark | 175/107 |
| 4,211,521 | 7/1980 | Streicher | 418/48 |
| 4,646,856 | 3/1987 | Dismukes | 175/107 |
| 4,721,172 | 1/1988 | Brett et al. | 175/107 |

*Primary Examiner*—John J. Vrablik

*Attorney, Agent, or Firm*—Robert G. Upton

[57] ABSTRACT

A progressive cavity drilling motor is disclosed with a multiplicity of helically formed conduits positioned in a resilient stator. The conduits are placed between an inner wall of a motor casing and a helically formed through hole formed by the stator. The conduits are located in parallel with each of the semi circular lobes thereby reducing the thickness of the elastomer in the lobe area resulting in a reduction of the hysteresis in the elastomer that is caused by cyclic stress reversals of the stator during motor operation. The conduits additionally divert a portion of the drilling fluid through the stator conducting heat therefrom. In addition, one or more of the conduits may be utilized as a communication channel therethrough for measurement while drilling capabilities.

4 Claims, 3 Drawing Sheets

MOINEAU MOTOR WITH CONDUITS THROUGH THE STATOR

BACKGROUND OF THE INVENTION

1. Field of the Invention

The present invention relates to a Moineau type progressive cavity positive displacement downhole drilling motor that uses high pressure fluid to drive the rotor.

More specifically, it is a means to improve the life expectancy of the motor's elastomeric stator and provide conduits for data transmission.

2. Description of the Prior Art

A state of the art positive displacement progresive cavity drilling motor is constructed with an outer steel tubular housing with an elastomeric liner (usually a nitrile type rubber) vulcanized and bonded to the inside diameter of the tubular housing. A through hole is formed in the center of the elastomeric liner having a multiplicity of essentially semi-circular profiled convoluted lobes. This forms the stator for the mating convoluted steel rotor, which has one less lobe than the aforesaid stator. The number of lobes on the rotor/stator power section is predicated on the desired speed of revolution of the rotor.

It is evident, for example, that this construction, as shown in U.S. Pat. No. 2,085,115, creates a great variance in the cross sectional thickness of the elastomer between the lobes and the valleys separating them. This causes a large variance of the elastomeric (rubber) properties particularly in the wide and narrow sections. The cured elastomer properties (i.e. hardness, compression set, elastic modulus and other properties) are a time/-temperature function. A thin or narrow section reaches maximum curing temperature more quickly and stays at this temperature longer than the thicker or wider sections, thereby curing the thin sections to a greater degree. Therefore, the thin elastomeric sections have much different physical properties than the thick sections. In operation of the fluid or "mud" motor in an earthen formation, as the steel rotor is forced to rotate inside the elastomeric stator with non-uniform physical properties, the elastomer is subjected to an extremely high level of cyclic stress reversals.

The hysteresis that is inherent under the above conditions creates a large amount of heat that adds to the degradation of the elastomer. The elastomer reaches a limit in tensile strength and the high shear and tensile stresses imposed by the spinning helical rotor tears through the embrittled sections and large pieces are ripped out. This phenomenon is known as "chunking" in the drilling industry. Obiviously, chunking of the elastomer destroys the usefulness of the drilling motor.

Another limitation in all the prior art is the lack of a much needed means to directly transmit, through the motor, data generated by sensors at or near the drilling bit at the hole bottom to electronic processors located in the drill string above the downhole motor. This data, after processing, is transmitted to the surface by Measurement While Drilling (MWD) or other transmission systems.

Typical examples of the prior art, U.S. Pat. Nos. 3,840,080, 3,982,858, 4,059,165 and 4,646,856 all depict elastomeric stators with non-uniform cross-sections and none have means for electronic data transmission through the downhole motor. Therefore, all of the known prior art have elastomer problems and data transmissions limitations heretofore described

SUMMARY OF THE INVENTION

It is an object of the present invention to maintain the lowest temperature possible in the stator elastomer to minimize the heat degradation of the elastomer. This is accomplished by allowing a predetermined volume of drilling fluid to bypass the rotor/stator power train during the operation of the motor. The bypassed drilling fluid flows through a multiplicity of tubes made of steel or other suitable material. These axially spiralled tubes are imbedded in the elastomeric stator and are substantially equidistantly spaced between the convolutions of the elastomeric stator and the inner diameter of the motor housing. This configuration allows the bypassed fluid to efficiently cool the elastomer to minimize degradation of the elastomer.

Another object of the present invention is to place the convoluted tubes so that there is formed an essentially uniform cross section of elastomer. By forcing the tubes to be hot air carriers while the elastomeric stator is being cured, produces a stator that has essentially uniform physical properties throughout (i.e. hardness, elasticity, compression set and others). This minimizes localized embrittlement and subsequent chunking of the stator elastomer.

Still another object of the present invention is for the aforesaid tubes to provide passageways for hard wire or pressure communication between function sensors (i.e. drilling weight, torque, RPM, formation properties adjacent to or ahead of the drill bit and others) located at or near the bit to electronic data processors located in the drill string immediately above the drilling motor. The data is processed for transmittal to the surface by means of some Measurement While Drilling System.

Still another object of the invention is to provide a communication channel, whether hydraulic or electronic, to send control signals from a control device above the stator to a controlled (slave) device below the stator.

A progressive cavity drilling motor of the type that utilizes fluid as a motor driving mechanism is disclosed. The motor consists of a cylindrical housing with a helical rotor rotatably retained within the housing. An elastomeric stator forming an outside diameter is positioned against an inside diameter of the cylindrical housing. The stator further forms a helically configured internal cavity, the cavity forming a through hole with a multiplicity of semi circular lobes. The number of helical lobes formed by the stator is one more than the helical lobes formed on the rotor. The stator further forms a multiplicity of helical conduits substantially paralleling the lobes formed by the stator. The conduits are positioned in the stator between the inside diameter of the cylindrical housing and an apex of each of the lobes formed by the stator. The conduits may distribute a portion of the fluid therethrough thereby serving to remove heat that is generated during operation of the motor. It is desirable under certain conditions, such as limited drilling fluid availability, to fill the conduits with materials of high thermal conductivity to carry the aforesaid heat out of the elastomer to thereby enhance the life of the stator. The conduits further more uniformly distribute the thickness of the elastomer since the conduits parallel the lobes formed by the elastomer. The relatively uniform thickness of the elastomer serves to reduce the build up of heat due to hysteresis in the elastomer that is resultant from cyclic stress reversals of the elastomer during operation of the positive displacement drilling motor. The helical conduits may be formed by the stator or the conduits may be, for example, metal tubes. The metal conduits or tubes act as rigid back-ups for the elastomer, thereby reducing the residual deleterious effects of the hysteresis induced heat.

An advantage then of the present invention over the prior art is the diversion of a portion of the drilling fluid through the stator elastomer to remove heat from the motor during operation downhole.

Yet another advantage of the present invention over the prior art is the means in which hard wire, pressure pulse or other direct communication is transmitted through the stator to a measurement while drilling sub assembly located above the mud motor.

Another advantage is the means by which electronic, hydraulic, or other control signals may be communicated through the stator.

Still another advantage of the present invention over the prior art is the reduction of cross sectional area of each lobe of the stator thereby more uniformly distributing the thickness of the elastomer reducing the heat build up due to hysteresis in the material during operation.

A further advantage is that the helical fluid by-pass tubes can, when necessary, be filled with a material with high thermal conductivity to dissipate the aforesaid heat generated in the stator during operation of the motor.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
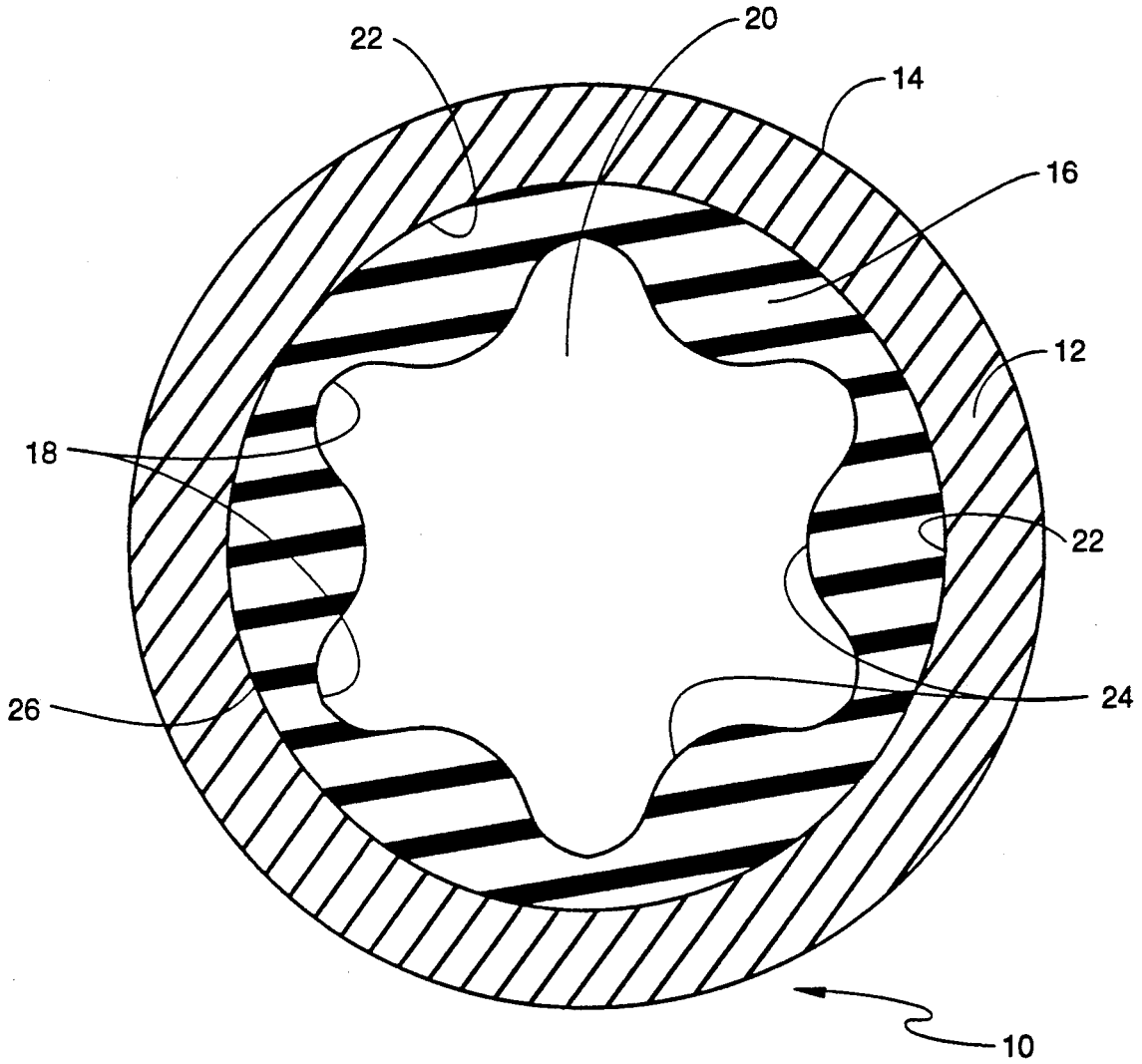
Prior Art Figure 1
FIG. 1 is a prior art cross-section taken normal to the axis of a typical Moineau type positive displacement motor or pump.

Referring now to the prior art illustrated in FIG. 1, the positive displacement motor or pump generally designated as 10 consists of a cylindrical fluid motor housing 12 forming inner and outer walls 22 and 14. Affixed to inner wall 22 is a stator 16 formed from a resilient material. Stator 16 consists of a series of helically formed lobes 24 separated by valleys 18 that results in a helically formed through hole 20. Typically, the outer wall 26 of the resilient stator is bonded to inner wall 22 of housing 12. In addition, it is common practice to form the stator 16 from rubber-like material such as synthetic nitrile compounds.

As heretofore stated, the prior art stator 16 with thick and thin sections represented by lobes 24 and valleys 18 suffer embrittlement, particularly in the thick elastomer sections 24 because of the relatively slow rate of heat dissipation from the thicker elastomer lobes 24. Cyclic stress reversals of the elastomer during motor operation is the primary culprit causing this destructive phenomenon.

Figure 2:
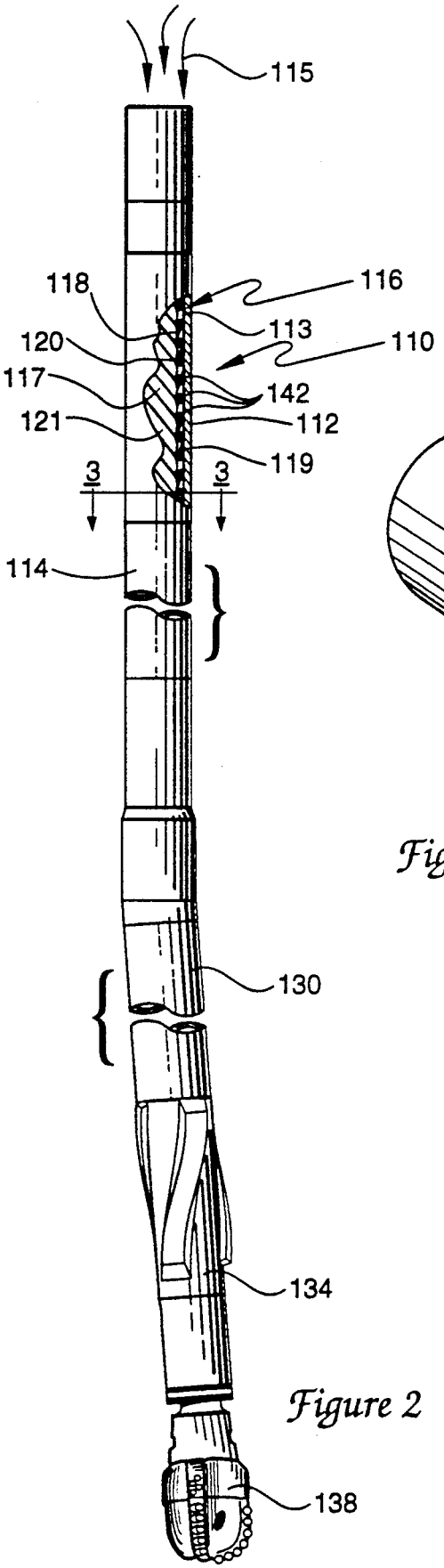
FIG. 2 is partially broken away cross-section of a positive displacement Moineau motor of the present invention attached to a bent sub assembly, a stabilizer and a drill bit.

Turning now to FIG. 2, the fluid motor assembly consists of the fluid motor generally designated as 110, bent sub 130, stabilizers 134 and drag rock bit 138. The foregoing assembly is typical of a directional drilling bottom hole assembly extending from a drill string (not shown).

Motor 110 consists of a cylindrical housing 112 that forms the outside diameter 114 (O.D.) and inside diameter 113 (I.D.). Cured and bonded to I.D. 113 of the housing 112 is a resilient stator generally designated as 116. Stator 116 forms a helical through hole 117 having semi-circular lobes 120 and valleys 118 defined as inner wall 121. In addition, helical tubes 142 are embedded in and bonded to the resilient stator 116 at the same time the stator 116 is cured and bonded to the housing I.D. 113. The helical tubes 142 are, for example, positioned essentially equidistantly between the helical stator valleys 118 and the bonded surfaces of the motor housing I.D. 113 and the stator O.D. 119 thereby forming a stator with an essentially uniform elastomer cross-section, ensuring even curing to provide uniform elastomer physical properties. During operation, the helical tubes 142 divert a predetermined portion of the drilling fluid 115 directed through the drill string from the drilling rig (not shown). The diverted fluid 115 again serves to cool the essentially uniform cross-section of the elastomeric stator 116.

Figure 3:
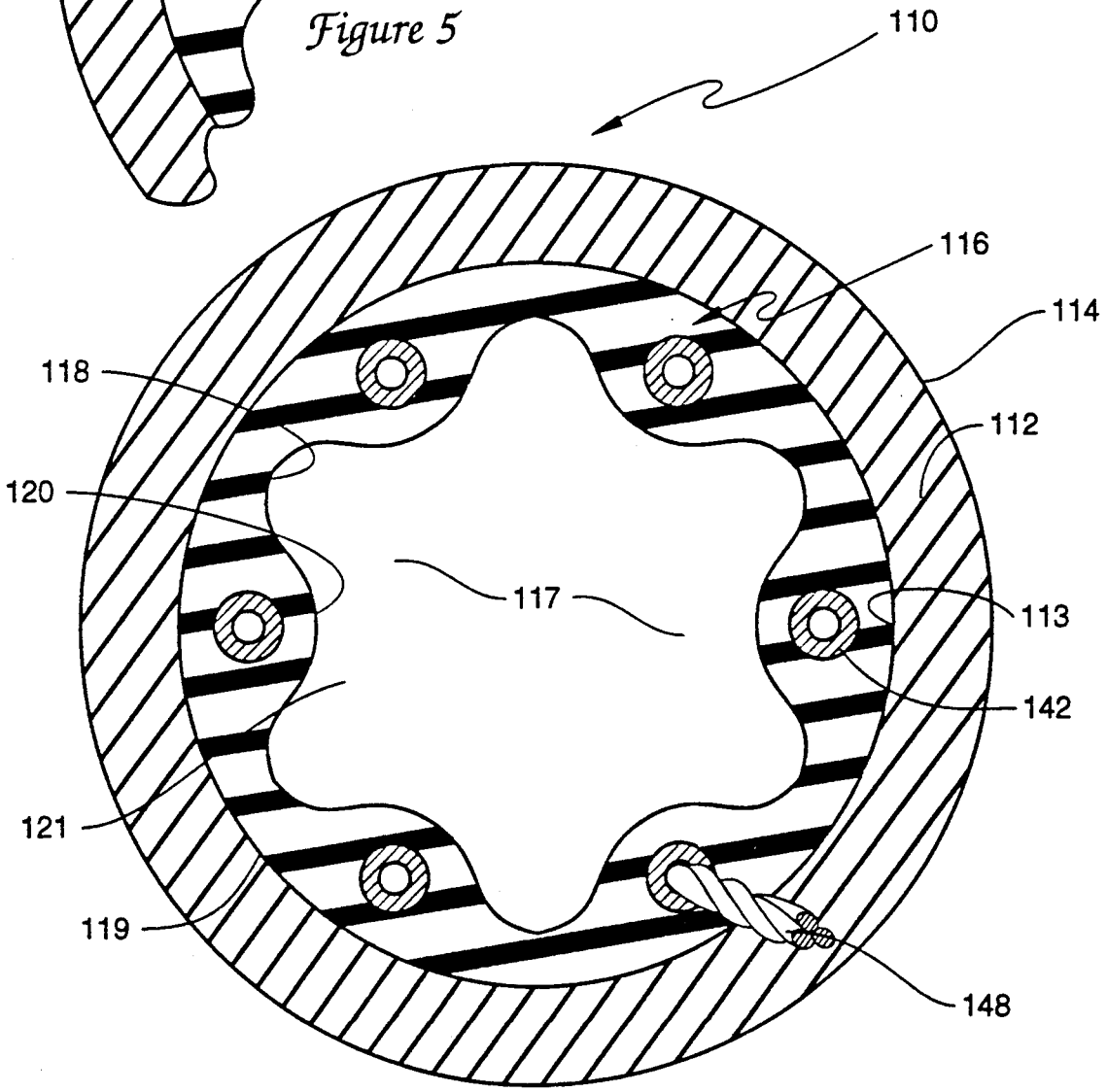
FIG. 3 is a cross-sectional view taken through 3—3 of FIG. 2.

The resilient stator 116 with the convoluted tubes 142 in place as shown in FIG. 3 is formed, for example, by affixing the helical tubes 142 near both ends of the motor housing 112 and inside the motor housing I.D. 113 equally spaced circumferentially and approximately equidistant between the motor bearing housing 113 and the crest of the resilient stator lobe 121. A mandrel (not shown) constructed to the geometry that will form the convoluted through hole 117 and the stator 116 is rigidly positioned coincident with the axis of the motor housing 112. Raw stock elastomer is then, for example, extruded into the annulus formed by the motor housing I.D. 113 and the convoluted surface of the mandrel (not shown). The spiral tubes are also completely surrounded by the elastomer. The complete assembly is then placed in a state of the art thermally controlled autoclave or other known heating device and brought up to the curing and bonding temperature of the elastomer (not shown). The spiral tubes 142, being heat conductors, function as temperature controls so that the elastomer mass has one even cure rate (not shown).

Figure 4:
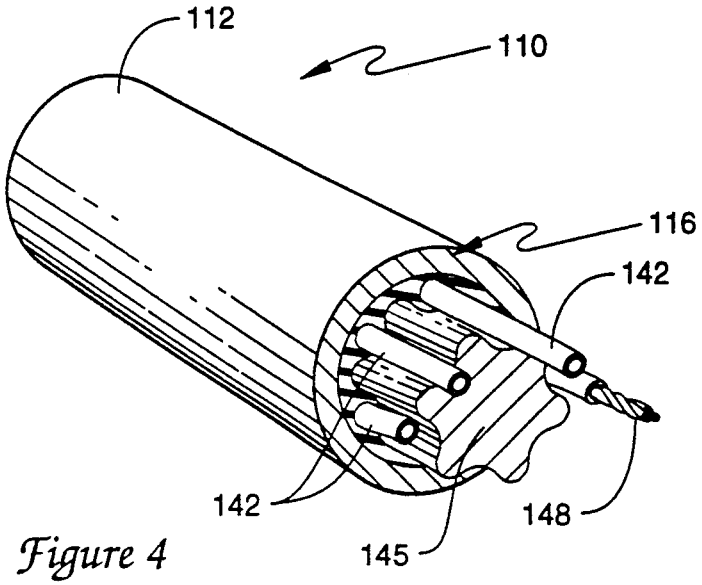
FIG. 4 is a perspective view illustrating a cross-section of the cylindrical housing, stator, helical rotor and helical fluid by-pass tubes.

FIG. 4 shows the convoluted tubes 142 extending through the elastomeric stator 116 and it is easy to visualize to one skilled in the art that these tubes 142 form excelent conduits for hard wire electronics 148, mud pulse, pressure, and other direct communication both ways, up or down, through the motor for Measurement While Drilling Systems. The motor rotor 145 is shown contained within through hole 117 of the stator 116.

It may be desirable under certain conditions, such as limited drilling fluid availability, to fill the conduits 142 with materials of high thermal conductivity to carry the aforesaid heat out of the elastomer to thereby enhance the life of the stator. Good heat conductors, for example, may include silver, copper, chemicals or compounds (i.e. heat sink compounds), etc.

The metal conduits or tubes act as rigid back-ups for the elastomer, thereby reducing the residual deleterious effects of the hysteresis induced heat.

Moreover, it may be desirable to utilize the conduits for cooling or data transmission means without diverting a portion of the drilling fluid therethrough without departing from the scope of this invention.

It is apparent that the conduits 142 serve as heat conductors with or without heat conductivity materials contained therein, especially if the tubes are fabricated from, for example, copper or silver.

Figure 5:
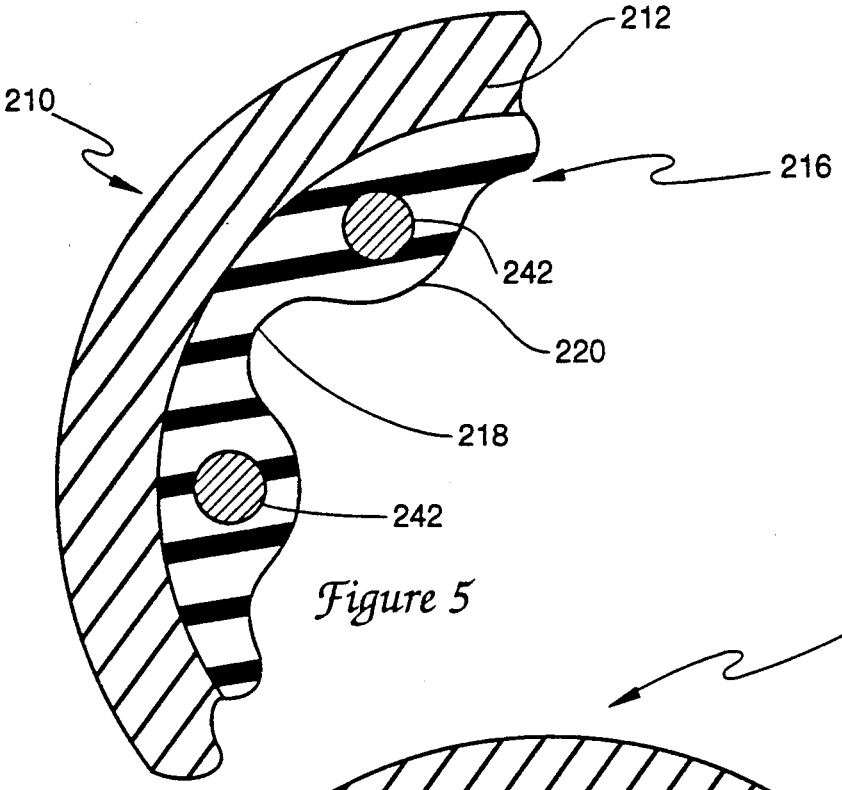
FIG. 5 is partial cross-sectional view of an alternative embodiment illustrating solid rods in place of the fluid by-pass tubes.

The alternative embodiment of FIG. 5 illustrates a motor 210 having solid heat conductive helically formed rods 242 imbedded within the stator 216 in place of the tubes 142 (FIG. 3).

It would additionally be obvious to form the conduits in the elastomer 116; the spiral voids serving to direct diverted drilling fluids, MWD hardwires or both therethrough (not shown).

It would be obvious to provide one or more stator cooling openings in the elastomer that parallel an axis of the motor without departing from the scope of this invention (not shown).

It would additionally be obvious to encapsulate communicating means such as wires in the stator elastomer for the transmission or transportation of data through the motor.

Drilling fluids 115 may be selected from a variety of well known materials such as drilling mud, gas or mist.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A progressive cavity drilling motor of the type that utilizes fluid as a motor driving mechanism comprising:

a cylindrical housing forming first and second ends, a helical rotor rotatably retained with said housing, an elastomeric stator forming an outside diameter postioned against an inside diameter of the cylindrical housing and a helical internal cavity, said cavity forming a through hole with a multiplicity of semicircular lobes, the number of helical lobes being one more than the helical lobes formed on the rotor, and said stator further forming one or more conduits, the conduits extending from said first and second ends of the housing, said conduits being positioned in the stator substantially between the inside diameter of the cylindrical housing and said internal cavity, said conduits further serves as a means to contain rock bit communication wires for the transmission of data to measurement while drilling sub assemblies positioned above the drilling motor.

2. The invention as set forth in claim 1 wherein said one or more conduits is replaced with one or more solid heat conductive helical rods, said rods serve to conduct heat away from said stator.

3. A method of fabricating a progressive cavity drilling motor of the type that utilizes fluid as a motor driving mechanism comprising the steps of:

forming a cylindrical housing, forming a helical rotor rotatably retained within said housing, forming an elastomeric stator, said stator forms an outside diameter positioned against an inside diameter of said cylindrical housing and a helical internal cavity, said cavity forming a through hole with a multiplicity of semi circular lobes, the number of helical lobes being one more than the helical lobes formed on the rotor, forming within said stator, a multiplicity of helical conduits substantially paralleling said lobes formed by said stator, said conduits being positioned in said stator substantially between said inside diameter of said cylindrical housing and an apex of each of said lobes formed by said stator, said conduits further more uniformly distribute the thickness of the elastomer since the conduits parallel the lobes formed by the elastomer, the relatively uniform thickness of the elastomer serving to reduce the heat build up due to hysteresis in the elastomer that is resulant from cyclic stress reversals of the elastomer during operation of the positive displacement drilling motor, and inserting one or more communication wires in one or more of said conduits to communicate measurement data therethrough.

4. The method as set forth in claim 3 further comprising the step of inserting solid heat conducting rods in place of said one or more helically formed conduits, said rods serve to conduct heat away from said elastomeric stator.

* * * * *